US009175450B2

(12) United States Patent
Weiner

(10) Patent No.: US 9,175,450 B2
(45) Date of Patent: Nov. 3, 2015

(54) BARRIER SYSTEM

(71) Applicant: Steven Weiner, Alamo, CA (US)

(72) Inventor: Steven Weiner, Alamo, CA (US)

( * ) Notice: Subject to any disclaimer, the term of this patent is extended or adjusted under 35 U.S.C. 154(b) by 134 days.

(21) Appl. No.: 14/085,863

(22) Filed: Nov. 21, 2013

(65) Prior Publication Data

US 2015/0137057 A1 May 21, 2015

(51) Int. Cl.
*E01F 13/02* (2006.01)

(52) U.S. Cl.
CPC ..... *E01F 13/028* (2013.01)

(58) Field of Classification Search
CPC ..... E01F 13/02; E01F 13/022; E01F 13/028
See application file for complete search history.

(56) References Cited

U.S. PATENT DOCUMENTS

| | | | | |
|---|---|---|---|---|
| 4,844,420 | A | 7/1989 | Oster | |
| 5,660,144 | A * | 8/1997 | Venti | 119/416 |
| 6,119,621 | A | 9/2000 | Johnson | |
| 6,375,164 | B1 | 4/2002 | Siegler et al. | |
| 6,375,165 | B1 * | 4/2002 | Sherratt et al. | 256/24 |
| 6,485,225 | B1 | 11/2002 | Baker | |
| 6,776,398 | B1 | 8/2004 | Tsai | |
| 6,807,999 | B1 * | 10/2004 | Bowen et al. | 160/24 |
| 6,830,236 | B2 | 12/2004 | Augusto de Lorenzo | |
| 7,316,388 | B2 | 1/2008 | Prismall | |
| 7,377,490 | B1 * | 5/2008 | Khosravian | 256/24 |
| 7,909,310 | B2 | 3/2011 | Weiner | |
| 2008/0251625 | A1 | 10/2008 | Bentley | |
| 2009/0293191 | A1 | 12/2009 | Koyzan et al. | |
| 2011/0120823 | A1 | 5/2011 | Hansen et al. | |
| 2013/0032773 | A1 * | 2/2013 | Jette | 256/65.02 |

* cited by examiner

*Primary Examiner* — Michael P Ferguson
*Assistant Examiner* — Jonathan Masinick
(74) *Attorney, Agent, or Firm* — Carter, DeLuca, Farrell & Schmidt, LLP

(57) ABSTRACT

A barrier system is provided for fencing in or closing off a designated area. The barrier system includes a body including a longitudinal element extendable from the body to form a barrier between a first surface and a second surface. At least one coupling member is selectively connectable with the body between a first connection configuration such that the body is coupleable to the first surface or the second surface via the at least one coupling member and a second connection configuration such that the body is directly attachable to the first surface or the second surface. Systems and methods are disclosed.

18 Claims, 4 Drawing Sheets

BARRIER SYSTEM

TECHNICAL FIELD

The present disclosure generally relates to barriers, and more particularly to versatile portable barriers for fencing in or closing off a designated area.

BACKGROUND

Barriers and/or fencing systems are used to block off a designated area and/or to delineate a pathway in various settings including, for example, airport security, shopping check-out lines, theme park lines, etc. Barriers can also be used to demarcate a perimeter of a crime scene, a scene of an accident or a job site and/or also include visual indicia to passersby.

Barrier systems often include a retractable rope that extends between posts or stanchions forming a barrier therebetween. These barrier systems occupy a substantial amount of space and lack versatility in their application. Additional deficiencies of current barrier systems include an inability to form provisional and/or permanent barriers between both metal and non-metal surfaces while maintaining separate components of the barrier system as one integral unit. This disclosure describes improvements over these prior art technologies.

SUMMARY

Accordingly, in one embodiment, in accordance with the principles of the present disclosure, a barrier system is provided. The barrier system includes a body including a longitudinal element extendable from the body to form a barrier between a first surface and a second surface. The barrier system includes at least one coupling member selectively connectable with the body between a first connection configuration and a second connection configuration. In the first connection configuration, the body is coupleable to the first surface or the second surface via the at least one coupling member. In the second connection configuration, the body is directly attachable to the first surface or the second surface.

In one embodiment, in accordance with further principles of the present disclosure, a barrier system is provided. The barrier system includes a reel including a longitudinal element extending between a first end engaged with the reel and a second end having a connector to form a barrier between a first surface and a second surface. At least a portion of the reel is magnetic. The barrier system includes at least one coupling member having a first side and a second side opposite the first side. The first side includes a suction cup connectable with one of the surfaces and the second side is connectable with the reel.

In one embodiment, in accordance with additional principles of the present disclosure, a barrier system for fencing in or closing off a designated area is provided. The barrier system comprises a reel extending between a first end and a second end having a magnetic sidewall disposed therebetween. The reel includes a tape extending between a first end disposed in the reel and a second end having a magnetic connector. A first coupling member has a first side and a second side. The first side includes a suction cup configured for connection with a first fixed surface and the second side is connectable with the magnetic sidewall. A second coupling member has a first side and a second side. The first side includes a suction cup configured for connection with a second fixed surface and the second side is connectable with the magnetic connector. The first and second coupling members are selectively connectable with the reel between a first connection configuration and a second connection configuration. In the first connection configuration, the second side of the first coupling member is connected with the magnetic sidewall of the reel and the second side of the second coupling member is connected with the magnetic connector of the reel. In the second connection configuration, the second sides of the first and second coupling members are connected with the first and second ends of the reel, respectively.

BRIEF DESCRIPTION OF THE DRAWINGS

The present disclosure will become more readily apparent from the specific description accompanied by the following drawings, in which.

DETAILED DESCRIPTION

Figure 1:
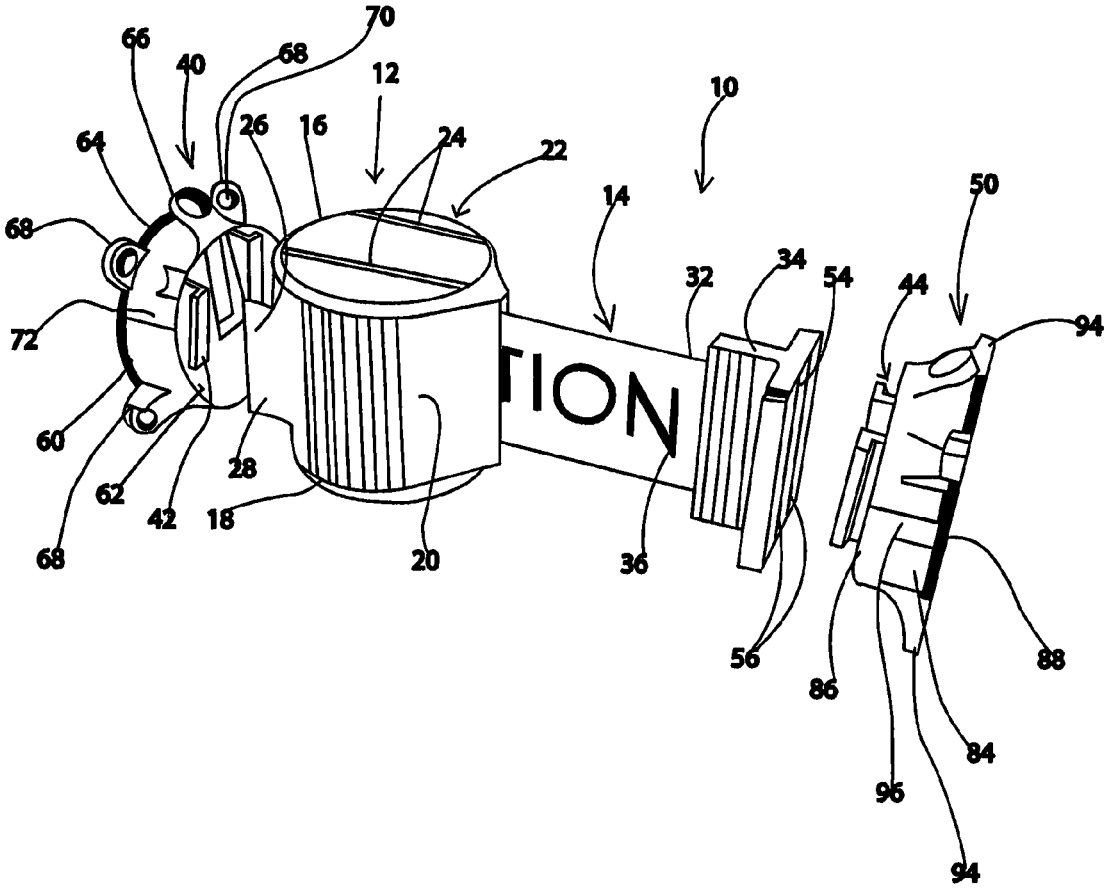
FIG. 1 is a perspective view of one embodiment of a barrier system in accordance with the principles of the present disclosure.
Figure 2:
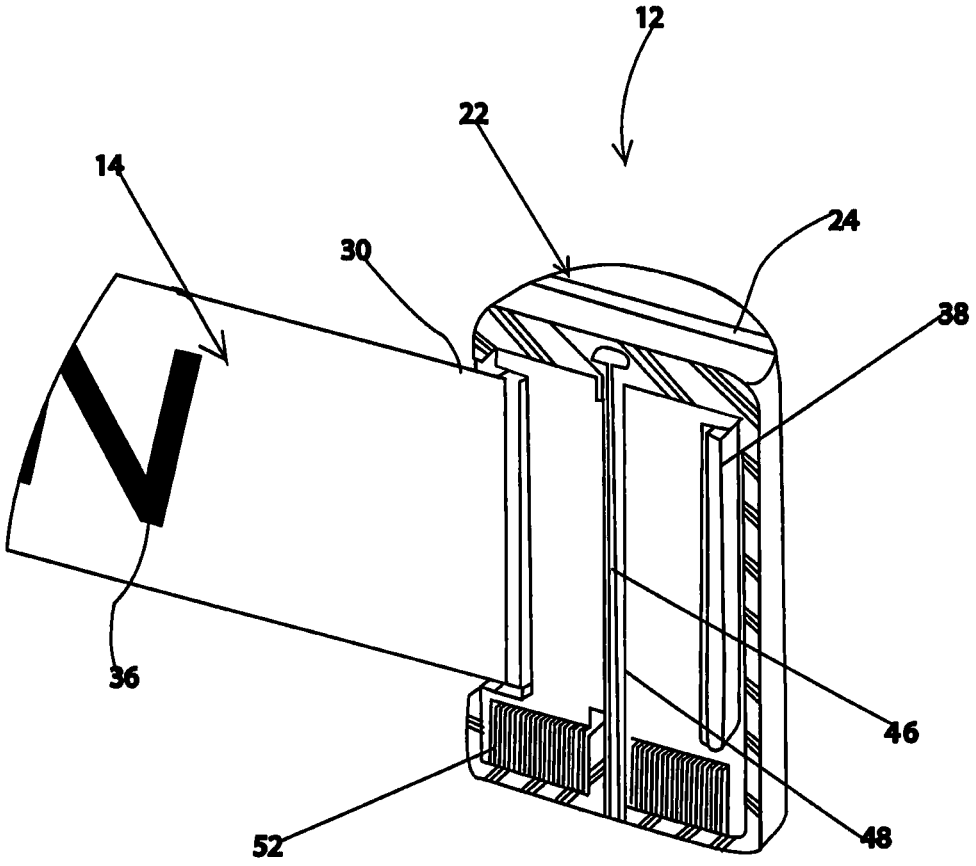
FIG. 2 is a cross section view of components of the system shown in FIG. 1.
Figure 3:
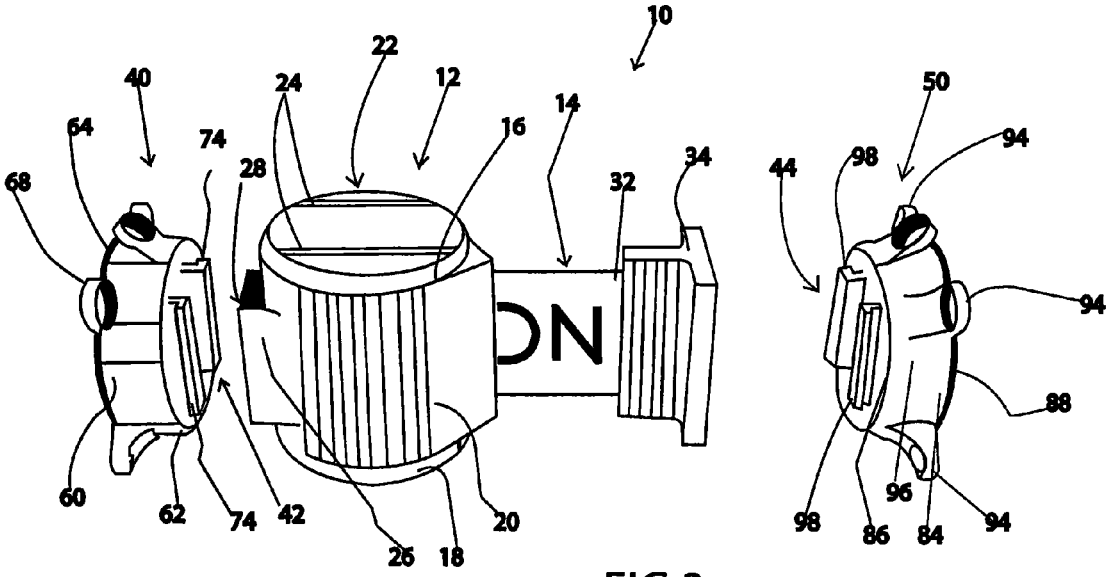
FIG. 3 is a side, perspective view of the system shown in FIG. 1.

The exemplary embodiments of the system and related methods of use disclosed are discussed in terms of barriers, and more particularly, in terms of a portable barrier system designed for fencing in or closing off a designated area or areas.

In embodiments, a barrier system is provided that can be used on both metal/magnetic and non-metal/non-magnetic surfaces. In one embodiment, the barrier system can be a permanent wall mount. The barrier system includes a head, such as, for example, a reel. The reel includes a longitudinal element, such as, for example, an extendable and retractable ribbon for forming a barrier between two surfaces. In it is contemplated that the ribbon is approximately 30 ft in length. In some embodiments, at least a portion of a casing of the reel is magnetic. It is envisioned that one side of the reel is magnetic and a ribbon handle for connecting the ribbon to a surface is magnetic such that the reel can be fixed to a metal surface and the ribbon handle can be fixed to a metal surface. In embodiments, the ribbon forms a barrier between two metal surfaces.

In embodiments, the barrier system includes a coupling member, such as, for example, a suction cup. The suction cup can be detachably fixed to a metal or non-metal surface and detachably connected to the reel. In aspects of the present disclosure, a side of the suction cup is magnetic for magnetic connection with the reel. In one embodiment, the suction cup includes a lever lock. In some embodiments, the barrier system includes two suction cups. One suction cup is connectible with the reel and the other suction cup is connected to the ribbon handle such that the barrier system can be secured between two non-metal surfaces. In embodiments, the suction cups include screw holes such that the barrier system can be permanently fixed to wall surfaces.

In aspects of the present disclosure, when the suction cups are not in use, for example, when a barrier is to be formed between two metal surfaces, the suction cups can be engaged to top and bottom ends of the reel to maintain the barrier system as one integral unit. In one embodiment, the suction cups can be engaged to top and bottom ends of the reel via a slide track engagement.

It is contemplated that the barrier system includes a magnetic reel that can be secured between metal surfaces, suction cups that can secure the barrier system to non-metal surfaces and which remain connected to the reel during non-use, and/or screw holes for permanently securing the barrier system with surfaces.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a system in accordance with the principles of the present disclosure. Alternate embodiments are also disclosed. Reference will now be made in detail to the exemplary embodiments of the present disclosure, which are illustrated in the accompanying figures. Turning to FIGS. 1-6, there is illustrated components of a system, such as, for example, a portable barrier system 10 for fencing in or closing off a designated area in accordance with the principles of the present disclosure.

The components of system 10 can be fabricated from metals, magnetic materials, synthetic polymers, and ceramics. The components of system 10, individually or collectively, may also be fabricated from materials such as plastic, nylon, stainless steel alloys, aluminum, commercially pure titanium, titanium alloys, Grade 5 titanium, super-elastic titanium alloys, cobalt-chrome alloys, stainless steel alloys, superelastic metallic alloys (e.g., Nitinol, super elasto-plastic metals, such as GUM METAL® manufactured by Toyota Material Incorporated of Japan), ceramics and composites thereof such as calcium phosphate (e.g., SKELITE™ manufactured by Biologix Inc.), thermoplastics such as polyaryletherketone (PAEK) including polyetheretherketone (PEEK), polyetherketoneketone (PEKK) and polyetherketone (PEK), carbon-PEEK composites, PEEK-BaSO4 polymeric rubbers, polyethylene terephthalate (PET), fabric, silicone, polyurethane, silicone-polyurethane copolymers, polymeric rubbers, polyolefin rubbers, hydrogels, semi-rigid and rigid materials, elastomers, rubbers, thermoplastic elastomers, thermoset elastomers, elastomeric composites, rigid polymers including polyphenylene, polyamide, polyimide, polyetherimide, polyethylene, epoxy. Various components of system 10 may have material composites, including the above materials, to achieve various desired characteristics such as strength, rigidity, elasticity, compliance, and durability. The components of system 10, individually or collectively, may also be fabricated from a heterogeneous material such as a combination of two or more of the above-described materials. The components of system 10 may be monolithically formed, integrally connected or include fastening elements and/or instruments, as described herein.

System 10 includes a body, such as, for example, a cylindrical reel 12. In some embodiments, reel 12 is variously shaped, such as, for example, oval, oblong, triangular, rectangular, square, polygonal, irregular, uniform, non-uniform, variable and/or tapered. Reel 12 includes a longitudinal element, such as, for example, a tape 14 extendable from reel 12 to form a barrier between two surfaces, such as, for example, two walls. At least a portion of reel 12 is magnetic to secure system 10 to at least one metal wall, as described herein.

Reel 12 extends between an end 16 and an end 18 having a sidewall 20 disposed therebetween. Each of ends 16, 18 include a mating part, such as, for example, a female mating part 22 configured for detachable mating engagement with male mating parts 42, 44 of coupling members 40, 50, to be described below. Female mating part 22 includes an inner surface defining a pair of cavities or channels 24 aligned in a parallel orientation for sliding engagement with male mating parts 42, 44 of coupling members 40, 50. Cavities 24 define a pair of crescent shaped sections and a rectangular section disposed between the crescent-shaped sections. Cavities 24 have an L-shaped cross section configuration. In some embodiments, ends 16, 18 of reel 12 are engagable with coupling members 40, 50 via various fastening engagements, such as, for example, hinged engagement, frictional engagement, threaded engagement, mutual grooves, screws and/or nails.

Figure 6:
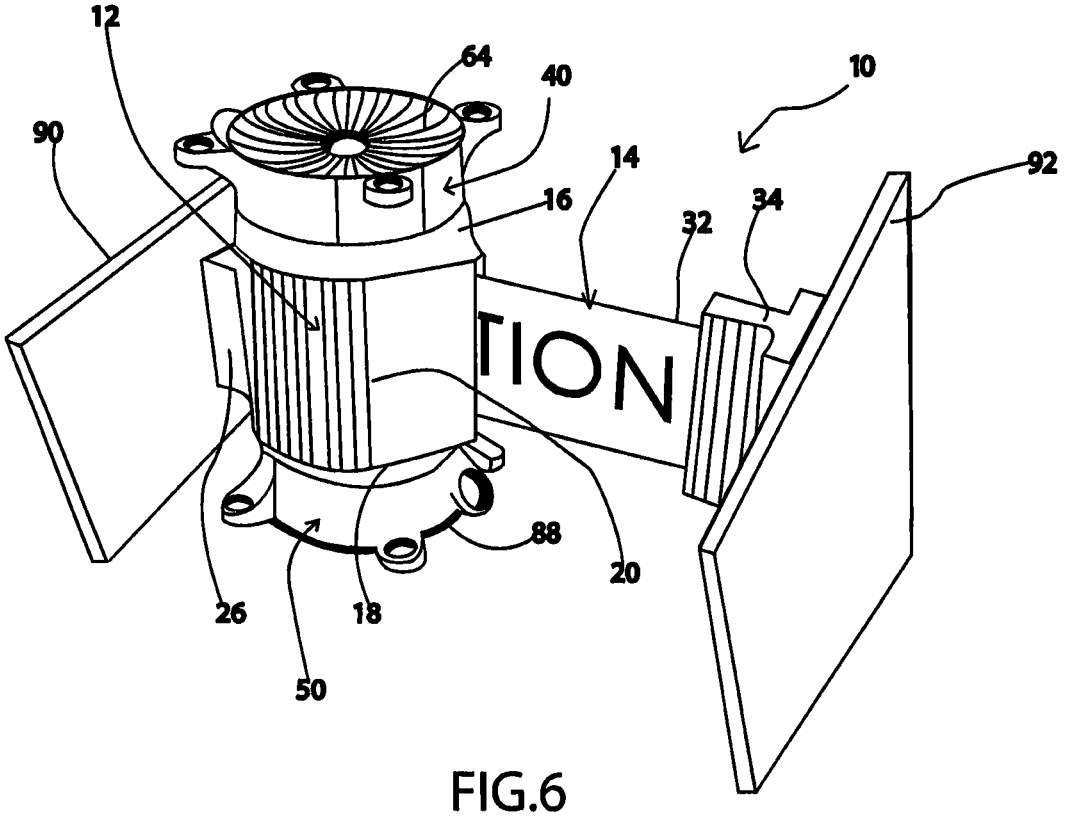
FIG. 6 is a perspective view of the system shown in FIG. 5, disposed with surfaces.

Sidewall 20 has a cylindrical shape and includes a magnetic portion 26 directly attachable to a surface, such as, for example, a fixed metal surface 90, as shown in FIG. 6. Magnetic portion 26 includes a mating part 28, similar to female mating part 22 described herein. Mating part 28 is configured for mating engagement with coupling member 40 such that magnetic portion 26 is selectively connectible with coupling member 40 or fixed metal surface 90.

Tape 14 extends between an end 30 connected to reel 12 and an end 32 having a connector 34. Tape 14 forms a barrier between surfaces or structures. Tape 14 is constructed of nylon. In some embodiments, tape 14 is constructed of various materials, such as, for example, those alternative materials described herein. Tape 14, as shown in the illustrated exemplary embodiment of FIG. 1, includes a banner 36 having visual indicia, such as, for example, the words "CAUTION." In some embodiments, tape 14 can include various visual indicia, such as, for example, phrases indicating danger or warning, instructions, logos, slogans or any other appropriate messages depending on the requirements of a particular application of system 10. End 30 is disposed in reel 12 and wound about a rotatably connected spool 38 such that tape 14 is extendable and retractable from reel 12. Spool 38 has a cylindrical shape and is rotatably disposed with a spindle rod 46 extending through a central cavity or passageway 48 defined in spool 38. Reel 12 includes a rewind tension spring 52 engaged with spool 38 that resiliently biases spool 38 in a rotational direction such that tape 14 is maintained in a wound condition about spool 38. Tape 14 can be unwound and extended from reel 12 by applying a pulling force to end 32 overcoming the resilient bias of spring 52.

Tape 14 includes connector 34 disposed at end 32 of tape 14 to fix tape 14 in an extended position via a connection between connector 34 and a surface, such as, for example, a fixed metal surface 92. Connector 34 is magnetic and configured for connection to fixed metal surface 92, and/or coupling member 50, which is connectable to a surface, such as, for example, a fixed non-metal surface 82. Connector 34 has a T-shaped cross section configuration and a face 54 having a planar surface configuration designed to rest flush with a surface, such as, for example, fixed non-metal surface 82 or some other structure or surface. Planar face 54 includes a pair of cavities or channels 56, similar to cavities or channels 24 described herein. Cavities or channels 56 are aligned in a parallel orientation configured for sliding connection with mating part 44 of coupling member 50, as described herein. In some embodiments, face 54 has various surface configurations, such as, for example, rough, undulating, porous, semi-porous, dimpled, polished and/or textured. In some embodiments, connector 34 has variously shaped cross section configurations, such as, for example, square, oval, hexagonal, oblong, triangular, rectangular, square, polygonal, irregular, uniform, non-uniform, variable and/or tapered.

System 10 includes at least one coupling member, such as, for example, coupling member 40. Coupling member 40 is selectively connectible with reel 12 between a first connection configuration and a second connection configuration. In the first connection configuration, reel 12 is coupleable to a surface, such as, for example, fixed non-metal surfaces 80 or 82, via coupling member 40. In the second connection configuration, reel 12 is directly attachable to a surface, such as, for example, fixed metal surfaces 90 or 92 without implementing coupling member 40.

Coupling member 40 has a generally disc-shaped configuration. Coupling member 40 includes a side 60 and a side 62, oriented in an opposite direction as side 60. Side 60 includes a suction cup 64 configured for connection with surfaces, such as, for example, fixed non-metal surfaces 80 or 82, or fixed metal surfaces 90 or 92. In some embodiments, suction cup 64 is configured for connection to various surfaces and/or walls, such as, for example, metal, non-metal, plastic, rubber, stone, granite, plaster, concrete, dry wall, glass and/or composites. Suction cup 64 is constructed of an adherent and flexible material, such as, for example, rubber. Suction cup 64 includes a lever lock 66 to increase a pressure differential between fixed non-metal surfaces 80 or 82 and suction cup 64.

Side 60 of coupling member 40 includes lateral extensions 68 each defining a cavity 70 configured for disposal of a fastener, such as, for example, a screw (not shown). Cavities 70 have a circular shape, which is sized for a correspondingly sized screw. Extensions 68 extend radially from a contoured outer surface 72 of coupling member 40 such that extensions 68 are disposed flush with fixed non-metal surface 80 or fixed non-metal surface 82 when coupling member 40 is pressed against fixed non-metal surface 80 or fixed non-metal surface 82.

Side 62 of coupling member 40, which is oriented in an opposite direction as suction cup 64, is connectable with magnetic portion 26 of sidewall 20 in the first connection configuration and/or one of ends 16, 18 in the second connection configuration. Side 62 includes a mating part, such as, for example, male mating part 42. Male mating part 42 is configured for mating engagement with magnetic portion 26 of sidewall 20 in the first connection configuration. Male mating part 42 is also configured for mating engagement with female mating part 22 of one of ends 16, 18 of reel 12 in the second connection configuration. Male mating part 42 includes a pair of protrusions or rails 74 aligned in a parallel orientation configured for sliding connection with cavities or channels 24 of one of ends 16, 18 of reel 12. Protrusions or rails 74 have an L-shaped cross section configuration corresponding to cavities 24 such that protrusions 74 are maintained within cavities 24 and any movement of coupling member 40 relative to reel 12 other than sliding movement is resisted and/or prevented. In one embodiment, side 62 of coupling member 40 is magnetically connectible with magnetic portion 26 of reel 12. In some embodiments, protrusions 74 have alternate cross section configurations, such as, for example, V-shaped, U-shaped, linear, oval, tapered, wedge-shaped, uniform, non-uniform and/or arcuate.

System 10 includes coupling member 50, similar to coupling member 40. Coupling member 50 includes a side 84 and a side 86, opposite side 84. Side 84 includes a suction cup 88, similar to suction cup 64 described herein. Suction cup 88 is configured for connection with a surface, such as, for example, fixed non-metal surface 82. Side 84 includes lateral extensions 94, similar to lateral extensions 68 described herein. Extensions 94 extend radially from a contoured outer surface 96 of coupling member 50 such that extensions 94 are disposed flush with fixed non-metal surface 82 when coupling member 50 is pressed against fixed non-metal surface 82.

Side 86 of coupling member 50, which is oriented in an opposite direction as side 84, is connectable with magnetic connector 34 of tape 14 in the first connection configuration and/or one of ends 16, 18 of reel 12 in the second connection configuration. Side 86 includes a mating part, such as, for example, male mating part 44, similar to male mating part 42 described with regard to coupling member 40. Male mating part 44 includes a pair of protrusions or rails 98, similar to protrusions 74 described with regard to coupling member 40. Protrusions 98 are aligned in a parallel orientation configured for sliding connection with cavities or channels 56 of connector 34. Male mating part 44 is also configured for mating engagement with female mating part 22 of one of ends 16, 18 of reel 12 in the second connection configuration. In embodiments, side 86 of coupling member 50 is magnetically connectible with magnetic connector 34 of tape 14.

Coupling members 40, 50 are selectively connectible with reel 12 between the first connection configuration and the second connection configuration. For example, in the first connection configuration, reel 12 is coupleable to fixed non-metal surfaces 80 or 82 via coupling members 40, 50. In the second connection configuration, reel 12 is directly magnetically attachable to fixed metal surfaces 90 or 92.

Figure 4:
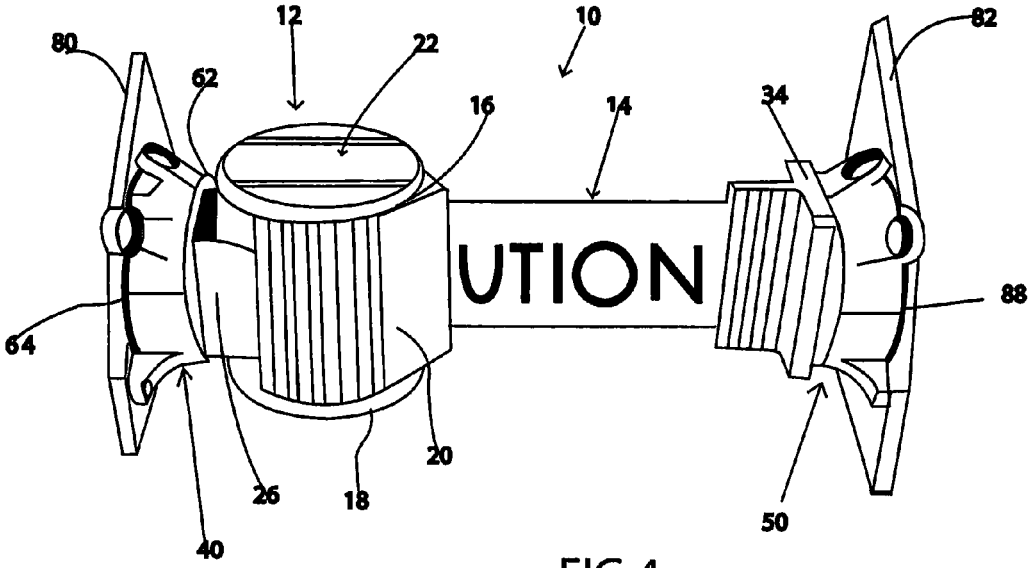
FIG. 4 is a side, perspective view of the system shown in FIG. 1 in a first connection configuration, disposed with surfaces.
Figure 5:
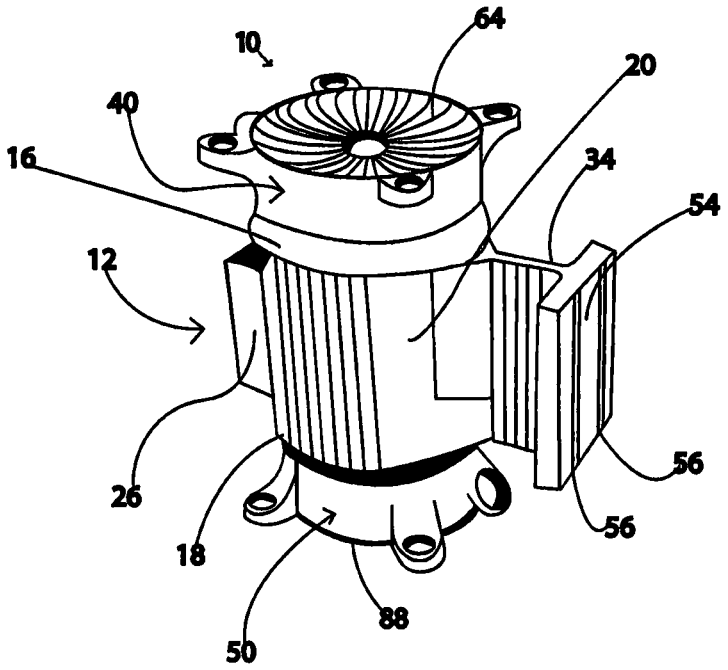
FIG. 5 is a perspective view of the system shown in FIG. 1 in a second connection configuration.

In operation, when it is desirable to fence in or close off a designated area defined between two surfaces, such as, for example, fixed non-metal surfaces 80, 82 or fixed metal surfaces 90, 92, barrier system 10 is employed. By way of example, barrier system 10 can be used to form a barrier between fixed non-metal surfaces 80, 82 by implementing coupling members 40, 50. In the first connection configuration, as shown in FIG. 4, suction cup 64 of coupling member 40 is connected to fixed non-metal surface 80 and suction cup 88 of coupling member 50 is connected to fixed non-metal surface 82. In some embodiments, coupling members 40, 50 are connected to various surfaces and structures, such as, for example, those alternatives described herein. Magnetic portion 26 of reel 12 is connected to side 62 of coupling member 40 via magnetic connection and/or mating engagement of mating parts 28, 42. A force is applied to end 32 of tape 14 to overcome the resilient bias of spring 62 causing tape 14 to unwind from spool 38 and extend from reel 12. Tape 14 is extended such that connector 34 engages side 86 of coupling member 50 to connect reel 12 with coupling member 50 forming a provisional barrier between fixed non-metal surfaces 80, 82. It is contemplated that coupling members 40, 50 can also be used when forming a barrier between two metal surfaces.

In some embodiments, a more permanent barrier can be formed between surfaces, such as, for example, fixed non-metal surfaces 80, 82. Fasteners (not shown) are positioned within extensions 68, 94 of each coupling member 40, 50 and inserted through fixed non-metal surfaces 80 and 82 to permanently connect coupling members 40, 50 with fixed non-metal surfaces 80, 82, respectively. With coupling members 40, 50 permanently connected to fixed non-metal surfaces 80, 82, reel 12 remains detachable from coupling members 40, 50 such that reel 12 can be disconnected from coupling member 40, 50 for use with a plurality of other coupling members and/or surfaces.

In some embodiments, barrier system 10 can be used to form a barrier between surfaces, such as, for example, fixed metal surfaces 90, 92 without utilizing coupling members 40, 50. For example, coupling members 40, 50 are connected to reel 12 in the second connection configuration, as shown in FIG. 6. In the second connection configuration, coupling member 40 is connected with end 16 of reel 12 via magnetic connection and/or mating engagement of mating parts 22, 42 and coupling member 50 is connected with end 18 of reel 12 via magnetic connection and/or mating engagement of mating parts 22, 44. In this way, coupling members 40, 50 remain attached with reel 12 (i.e., maintain reel 12 and coupling members 40, 50 as one integral unit) without interfering with the ability of reel 12 to form a barrier between surfaces.

Magnetic portion 26 of sidewall 20 is magnetically attached to fixed metal surface 90. A force is applied to end 32 of tape 14 to overcome the resilient bias of spring 62 causing tape 14 to unwind from spool 38 and extend from reel 12. Tape 14 is extended such that connector 34 magnetically attaches to fixed metal surface 92 forming a provisional barrier between fixed metal surfaces 90, 92. In this way, portable barrier system 10 can be used to form a barrier between various types of surfaces including metal and/or non-metal surfaces without using a post or stanchion and while being capable of maintaining its components, for example, coupling members 40, 50 and reel 12, as one integral unit.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A barrier system, comprising:

a reel body including a top end surface and a bottom end surface and a sidewall extending between the top end surface and the bottom end surface, at least one of the top end surface or the bottom end surface having a female mating part or a male mating part;

a longitudinal element extendable from the body for forming a barrier between surfaces; and at least one coupling member having a first side and a second side having the other of the female mating part or the male mating part, the at least one coupling member being selectively connectable with the body between a first connection configuration in which the second side of the at least one coupling member is removably secured to the sidewall of the body such that the body is coupleable to a surface via the at least one coupling member, and a second connection configuration in which the other of the female mating part or the male mating part of the second side of the at least one coupling member is removably secured to a complimentary one of the female mating part or the male mating part of the at least one of the top end surface or the bottom end surface of the body such that the body is directly attachable to a surface.

2. A barrier system as recited in claim 1, wherein the body includes a magnetic portion configured for mating engagement with the at least one coupling member.

3. A barrier system as recited in claim 2, wherein the first side of the at least one coupling member includes a suction cup.

4. A barrier system as recited in claim 1, wherein each of the bottom end surface of the body, the top end surface of the body, and the sidewall of the body is configured for detachable engagement with the second side of the at least one coupling member.

5. A barrier system as recited in claim 1, wherein the at least one coupling member includes a first coupling member and a second coupling member, in the first connection configuration the first coupling member is connected with the sidewall of the body and the second coupling member is connected with the longitudinal element, and in the second connection configuration the first coupling member is removably secured to one of the top end surface or the bottom end surface of the body, and the second coupling member is removably secured to the other of the top end surface or the bottom end surface of the body.

6. A barrier system as recited in claim 1, wherein the female mating part of the at least one of the top end surface or the bottom end surface includes a pair of cavities aligned in a parallel orientation and the male mating part of the second side of the at least one coupling member includes a pair of protrusions aligned in a parallel orientation configured for sliding connection with the cavities.

7. A barrier system as recited in claim 6, wherein the protrusions have an L-shaped cross section configuration.

8. A barrier system as recited in claim 1, wherein the body is cylindrical.

9. A barrier system as recited in claim 1, wherein the longitudinal element extends between a first end connected with the body and a second end including a magnetic connector configured for connection with the at least one coupling member.

10. A barrier system as recited in claim 9, wherein the connector includes a pair of cavities aligned in a parallel orientation configured for sliding connection with the at least one coupling member.

11. A barrier system as recited in claim 1, wherein the at least one coupling member includes at least two lateral extensions each defining a cavity configured for disposal of a fastener.

12. A barrier system as recited in claim 1, wherein the longitudinal element includes a tape.

13. The barrier system as recited in claim 1, wherein the body defines a longitudinal axis between the top end surface and the bottom end surface, and wherein when the at least one coupling member is connected to the body in the second connection configuration, the longitudinal axis of the body extends through the at least one coupling member.

14. A barrier system, comprising:

a reel including a bottom end surface and a top end surface and a sidewall extending between the top end surface and the bottom end surface, at least one of the top end surface or the bottom end surface having a female mating part or a male mating part;

a longitudinal element extending between a first end engaged with the reel and a second end having a connector for forming a barrier between surfaces, at least a portion of the reel being magnetic; and at least one coupling member having a first side and a second side opposite the first side, the second side having the other of the female mating part or the male mating part, the first side including a suction cup, the at least one coupling member being selectively connectable with the reel between a first connection configuration in which the second side of the at least one coupling member is removably secured to the sidewall of the reel such that the reel is coupleable to a surface via the suction cup of the at least one coupling member, and a second connection configuration in which the other of the female mating part or the male mating part of the second side of the at least one coupling member is removably secured to a complimentary one of the female mating part or the male mating part of the at least one of the top end surface or the bottom end surface of the reel.

15. A barrier system as recited in claim 14, wherein the at least one coupling member includes a first coupling member and a second coupling member, in the first connection configuration the first coupling member is connected with the sidewall of the reel and the second coupling member is connected with the connector and in the second connection configuration the first coupling member is removably secured to one of the top end surface or the bottom end surface of the reel, and the second coupling member is removably secured to the other of the top end surface or the bottom end surface of the reel.

16. A barrier system as recited in claim 14, wherein the second side of the at least one coupling member is configured for mating engagement with the magnetic portion of the reel.

17. A barrier system as recited in claim 14, wherein the at least one coupling member includes at least two lateral extensions each defining a cavity configured for disposal of a fastener.

18. A barrier system for fencing in or closing off a designated area, comprising:

a cylindrically-shaped reel extending between a top end and a bottom end and having a magnetic sidewall disposed therebetween, the reel defining a longitudinal axis between the top and bottom ends and including a tape extending between a first end disposed in the reel and a second end having a magnetic connector, the tape defining a longitudinal axis upon extension thereof that is perpendicular to the longitudinal axis of the reel, at least one of the top end or the bottom end having a female mating part or a male mating part;

a first coupling member having a first side and a second side, the first side including a suction cup configured for connection with a first fixed surface and the second side being connectable with the magnetic sidewall and at least one of the top or bottom ends of the reel, the second side having the other of the female mating part or the male mating part; and a second coupling member having a first side and a second side, the first side including a suction cup configured for connection with a second fixed surface and the second side being connectable with the magnetic connector and at least one of the top or bottom ends of the reel, wherein the first and second coupling members are selectively connectable with the reel between a first connection configuration in which the second side of the first coupling member is connected with the magnetic sidewall of the reel and the second side of the second coupling member is connected with the magnetic connector of the reel and a second connection configuration in which the other of the female mating part or the male mating part of the second side of the first coupling member is removably secured to a complimentary one of the female mating part or the male mating part of the at least one of the top or bottom ends of the reel, and the second side of the second coupling member is removably secured to the other of the top or bottom ends of the reel.

* * * * *